United States Patent [19]

Hewitt

[11] 4,231,172

[45] Nov. 4, 1980

[54] FLOATING DREDGER AND TREATMENT PLANT

[75] Inventor: James A. Hewitt, Chislehurst, England

[73] Assignee: F. W. Payne & Son (Bickley) Limited, Kent, England

[21] Appl. No.: 15,136

[22] Filed: Feb. 26, 1979

[30] Foreign Application Priority Data

Mar. 7, 1978 [GB] United Kingdom ..... 8947/78

[51] Int. Cl.[3] ..... E02F 1/00

[52] U.S. Cl. ..... 37/71; 37/195; 414/564

[58] Field of Search ..... 37/71, 195; 198/509, 198/557; 414/564, 567

[56] References Cited

U.S. PATENT DOCUMENTS

| | | | |
|---|---|---|---|
| 622,527 | 4/1899 | O'Hara | 37/71 X |
| 1,047,233 | 12/1912 | Jackson | 37/71 X |
| 1,345,121 | 6/1920 | Brown | 198/509 X |
| 3,143,816 | 8/1964 | Gardner, Jr. | 37/71 |
| 3,591,024 | 7/1971 | Runge | 414/567 |
| 3,688,893 | 9/1972 | Wallace, Jr. | 37/69 X |
| 3,756,375 | 9/1973 | Briggs | 198/509 |

FOREIGN PATENT DOCUMENTS

| | | | |
|---|---|---|---|
| 2262920 | 6/1974 | Fed. Rep. of Germany | 37/71 |

*Primary Examiner*—Clifford D. Crowder
*Attorney, Agent, or Firm*—Murray and Whisenhunt

[57] ABSTRACT

A dredging and treatment apparatus is provided for the working of alluvial deposits in deep waters in excess of 100 meters. The apparatus comprises an elongated pontoon having a container at one end and a treatment plant at the other. A plurality of grab units mounted on rails are movable from positions laterally of both sides of the pontoon to discharge positions over said container. A bucket elevator is pivoted at its upper end to support means on said pontoon so that its lower end may be moved to a position relative to the container section in accordance with the level of the material in the container. The treatment plant is thereby able to receive the material at a constant rate for onboard processing, the tailings being discharged back into the sea.

5 Claims, 5 Drawing Figures

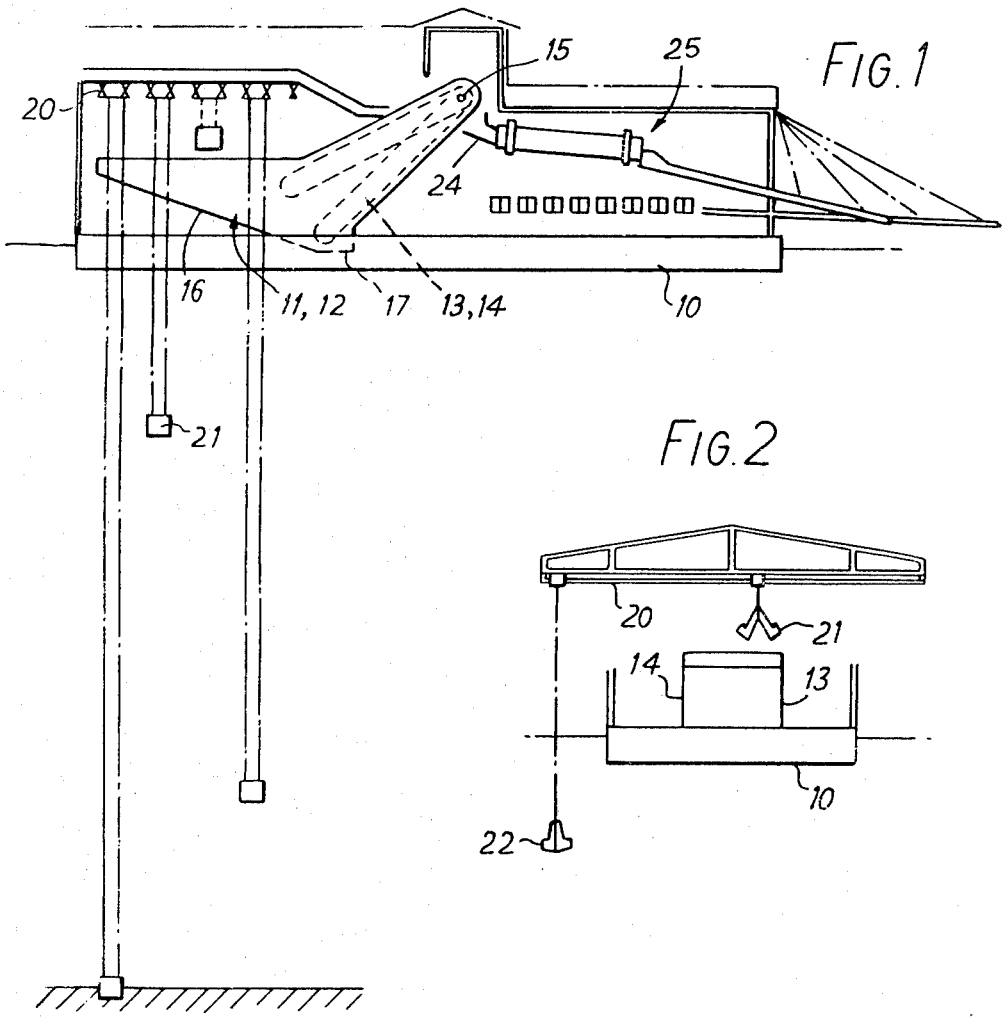
FIG. 1
FIG. 2
FIG. 3
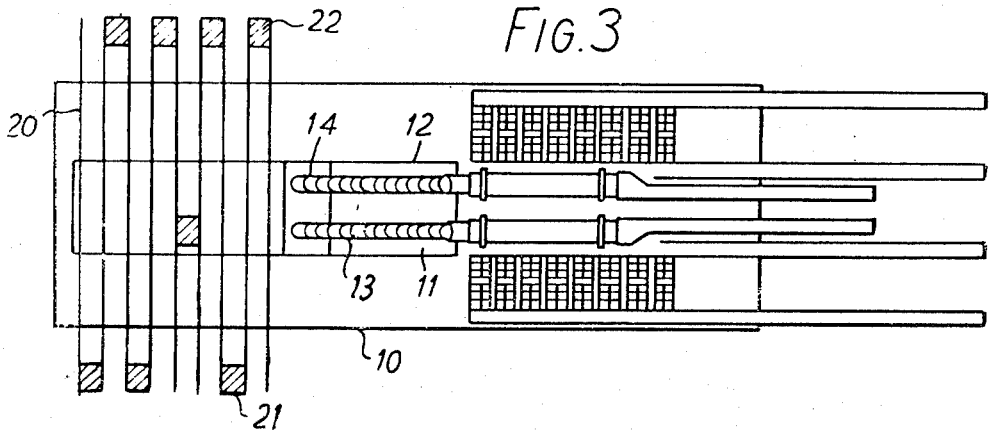

FLOATING DREDGER AND TREATMENT PLANT

BACKGROUND TO THE INVENTION

This invention relates to dredges particularly but not solely for dredging tin from the sea bed. As offshore mineral reserves get less and less in shallow areas within the range of conventional dredges much time and thought is being applied to other types of dredge that can operate successfully at greater depths. Alluvial areas have been found at depths of 300 ft plus and the dredge of the present invention is intended for operation of up to that depth although in principle it can be applied to much greater depths. A known early type of dredge was powered by steam and was equipped with 24 meters long ladder supporting a band of thirty eight 7.1/4 cu.ft. buckets capable of dredging to 12 meters below waterline. The dredge capacity was rated at 15,000 cu. meters per month. The treatment plant consisted of a trommel screen feeding undersize, which contained the tin ore, over chutes which were interspaced along their lengths with bars, behind which the concentrates lodged. In rotation the chutes (or palongs) would be closed down for workmen to dig out the trapped concentrate which was then transported ashore for washing up and upgrading.

The recovery efficiency of the treatment plant was low but these dredges show the viability of a bucket line dredge, albeit close to shore, for working off-shore alluvial deposits.

Dredges were developed later driven by diesel electric power having bucket sizes ranging from 7 to 22 cu. meters, dredging to depths varying from 18 to 50 meters and throughputs of 130,000/438,000 cu. meters per month.

Another form of known dredge comprises twin grabs delivering to a conventional treatment plant via collecting hoppers, conveyors and chutes. This unit operates at a maximum depth of 36 meters and has a rated throughput capacity of 220,000 cu. meters per month.

The dredge known as a suction cutter dredge is capable of dredging to nearly 25 meters below waterline and has a throughput reported at 320,000 cu. meters per month. During operations the dredge is moored on a spud which is a unique feature for a sea dredge.

The trailing suction dredge has two suction heads, one in use during port traverse and the other in use during starboard traverse and was specially designed for a particular area with a very shallow depth of alluvium although it is capable of dredging up to 25 meters below waterline.

The bucket line dredges working off Phuket Island, Thailand, were designed for operation in sheltered waters. Operators have carried out dredging in sheltered and exposed areas and their policy is to work the exposed areas during that part of the year when conditions are calm or relatively calm and continue in the sheltered areas during the monsoon season.

Many potential off-shore mining areas are being discovered which are exposed and do not have the advantage of natural adjacent shelter. Dredges for these locations, although basically similar to other dredges, have to incorporate features that will enable them to work all year round in all but the most severe conditions. During these periods dredging operations would stop but the dredges must still be capable of riding out the worst weather in a standby attitude.

Consideration has been given to the dredging of exposed relatively deep off-shore areas of the sea bed. For economic reasons it is considered necessary to operate for the major part of the year regardless of the prevailing climatic and sea conditions. Problems arise due to the pitch and heave of the dredger pontoon causing undesirable relative movement between the digging point at the bottom of the bucket ladder and the sea bed being excavated.

Other problems have to be considered and applied to off-shore bucket dredges operating in exposed waters:

(1) Design of basic pontoon and superstructures to withstand maximum wave conditions coupled with gale force wind.

(2) Greater freeboard than that acceptable for dredges working sheltered areas. More extensive bulwark protection around dredge.

(3) Articulation at the bottom, top or both ends of the ladder to ensure contact of the buckets with the digging face as the dredge pitches and heaves and also to reduce the magnitude of the impact loadings between the bottom end of the ladder and the sea bed and the resulting shock reactions at the ladder pivot point.

(4) A dredge mooring system that includes features such as automatic line out/line in measurement, line tension indications, line speed indicators and automatic tensioning of trailing lines. This must not only ensure safety in that the dredge is under full tensional control at all times but must also improve dredge throughput efficiency by permitting correct dredging procedures and techniques to be applied to the maximum advantage by the operator.

The development of the bucket line dredge over the years has basically been in the direction of deeper digging, increased capacity units incorporating technology advances as they have become available. Mechanical components, drive systems, treatment plant equipment and systems, tailings deposition and mooring techniques have all been developed, or have evolved, towards greater operational, mechanical and recovery efficiencies. This development is a continuing process as new dredging units are designed for ever increasing performances and duties.

Depths of 150/180 ft. for bucket dredges is considered the maximum possible. Beyond that range of depths limiting factors apply such as the physical sizes and weights of bucket line components, induced loadings in the bucket chain assembly which makes dredging operations more difficult and maintenance arduous and time consuming. It is important for financial viability that a dredge operates for a high percentage of available time and that downtime is kept to a minimum. As depths get greater operating time tends to get less and downtime greater.

The quests for methods of economically dredging off-shore deposits located at greater depths than can be reached by even the present day largest bucket or suction dredges continues to afford designers considerable technical difficulties.

One proposal put forward to meet the challenge was a scheme in which excavation would be effected by means of a continuous chain of dragline buckets passing under a pontoon hull while the dredge traverses similar to a conventional bucket dredge. Each bucket is suspended separately from two parallel catenary lines allowing, to some extent, movement independent of the neighbouring buckets. The profile of the catenary and depth of excavation is varied by altering the position of a submersed frame carrying an idler at the lower end around which the buckets pass. Above this idler at deck level is the drive unit for hauling the catenary lines. In order to maintain an optimum catenary profile the drive unit is capable of longitudinal movement on the pontoon. The buckets are raised over a tipping idler at one end of the dredge where the spoil is discharged into a collection hopper and thence to the various stages of on-board treatment.

Another proposal envisages an arrangement in which two 15 ton grabs would be used for operation in water depths up to 76 meters. A feature of this proposal is the use of a carriage for transporting each grab from the outboard digging position up an inclined tract to the final dumping position over an inboard hopper. The carriage also acts as a movable mounting for the jib-head sheaves. Transition of the grabs from vertical hoisting to the inclined tract is automatic and allows continuous operation without any slewing or luffing motion. Specially designed high pressure water jets traversing a grizzley above the receiving hopper were proposed as the method of breaking up any large clay lumps deposited from the grabs before entering the onboard treatment plant.

Whilst these proposals may well be feasible it is evident that there are many technical problems to be overcome. Furthermore, they would be costly to construct. It is therefore an object of the invention to provide a dredge which is economical to construct and yet overcomes many or all of the technical problems referred to above. It is also an object of the invention to provide an arrangement by which dredged material can be fed at a constant rate to a treatment plant to achieve maximum recovery efficiency. It is envisaged that dredging can be effected at depths well in excess of 100 meters.

SUMMARY OF THE INVENTION

According to the invention there is provided a dredging and treatment apparatus comprising in combination a buoyant elongated body having longitudinal extending sides, a container mounted on said buoyant body towards one end thereof, a plurality of rails extending transversely of the longitudinal axis of the body between positions laterally of the longitudinal side of the buoyant body and positions above the container, a plurality of grab units capable of moving along said rails between said positions laterally of said longitudinal side, where the grabs of said units can be lowered for charging with material and raised with its charge, and said positions over said container where the grabs can be discharged, support means on said buoyant body, an inclined bucket elevator pivoted to said support means at its upper end on an axis about which the buckets pass at the upper end of said elevator, the lower end of said bucket elevator being movable towards and away from the bottom of the container according to the level of the material therein, and a treatment plant mounted on said buoyant body towards the other end thereof for receiving the material delivered from the upper end of the bucket elevator, and outlet means from said treatment plant.

The dredge incorporates as many grab units as the capacity requirements demand. Grabs would be positioned on the port and starboard sides of the pontoon and staggered. In order that the whole system may be automatically controlled to give a constant dredged input, a cycling programme may be arranged to ensure the correct positional relationship of grabs from their respective points of suspension. The grab units are practically of standard design, horizontally mounted on rails so that when in their fully raised position they traverse inboard to discharge at positions above the container.

BRIEF DESCRIPTION OF THE DRAWINGS

A constructional form of the invention will now be described by way of example with reference to the accompanying drawings in which:

FIGS. 1, 2 and 3 are respectively schematic side and front elevations and a plan of a multi-grab dredge.

DESCRIPTION OF PREFERRED EMBODIMENT

Figure 4:
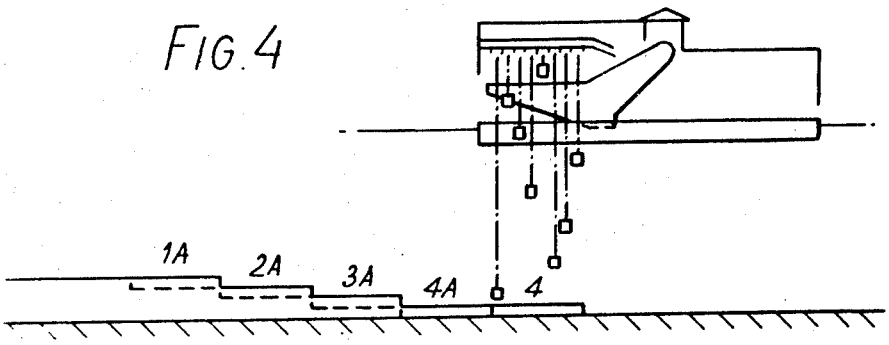
FIG. 4 is a schematic side elevation of the multi-grab dredge and section of the sea bed being excavated.

The dredge shown in FIGS. 1 to 3 comprises a pontoon 10 having installed thereon a pair of surge bins 11, 12 into which extend respectively endless articulated bucket elevators 13, 14. The latter are mounted to swing about a pivot 15 so that the lower end can follow the level of material fed to the surge bins. The bottom 16 of the surge bin slopes towards a sump region 17 into which the lower end of the elevator can reach.

Extending transversely across the pontoon and over the surge bins are rails 20 which support a number of underslung grabs 21, 22. The rails extend to port and starboard beyond the sides of the pontoon.

The elevators deliver the material to the inlet 24 of a conventional treatment plant and tailings discharge installation 25.

As shown in the embodiment four grabs are provided at each side of the dredge. The cycles of operation for the raising and lowering, both directions of traverse and opening and closing of the grabs are desynchronised, operating in sequence.

Figure 5:
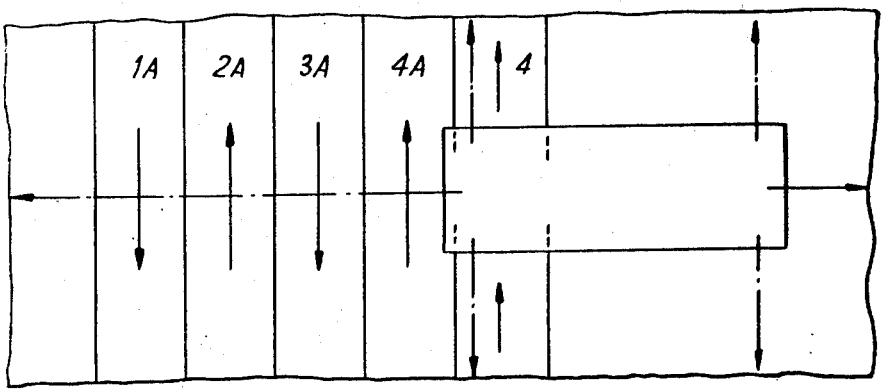
FIG. 5 is a plan showing the areas of the sea bed being excavated.

A sequence for excavating areas of the sea bed is as follows (the dredge being shown in FIGS. 4 and 5 excavating last section of cut i.e. section 4):

(a) Raise excavating depth of grabs—pull ahead to excavate Section 1A

(b) Lower excavating depth of grabs—drop back to excavate Section 2A

(c) Lower excavating depth of grabs—drop back to excavate Section 3A

(d) Lower excavating depth of grabs—drop back to excavate Section 4A.

The minimum width of each section equals the width of grab installation.

Initially, as with a bucket line dredge, the depth has to be established gradually.

The dredge is suitable for dredging to a depth of approximately 91 meters (300 ft) and capable of treating a throughput of 1000 tonnes per hour. The size of the pontoon is approximately 90 meters long$\times$33 meters wide (295 ft$\times$108 ft). The grab installation has been calculated on individual grab cycles of two minutes duration.

An advantage a grab dredge has over a conventional bucket line dredge is that the pontoon length is not affected by the length of a bucket ladder. This means that a grab dredge (to any depth) handling a throughput of say 1000 tonnes per hour would have a pontoon size, in plan, equivalent to a conventional bucket line dredge of similar capacity digging to 38 meters. Theoretically a bucket line dredge digging to 91 meters would require a pontoon 160 meters long.

The pontoon length for the projected multi-grab dredge would remain constant regardless of the dredging depth to which it is applied.

Assuming the length over the grabs to be 3 meters this would mean a theoretical dredge traversing speed of 3 meters per two minutes (assuming a two minute grab cycle) this is approximately 25/35% of the traversing speed of conventional bucket line dredges.

Rapid controlled descent of the grabs ensures a repetitive and reproducible grab pattern on the sea bed. Transducers fitted to the grabs enable them to be monitored continuously and indicated on a visual display. Known drift can be compensated for and effects of vessel heave can be taken care of by a suitable dredge mooring system. Arranging the cycles of the individual grabs so that a dredging pattern can be established ensures an even and constant excavation of the sea bed being mined and also provides the additional advantage of making constant, and therefore minimising, the power requirements of the grab system as a whole.

To ensure optimum dredge throughput at all times the cycle programme of the grabs is arranged to suit maximum depth conditions. As the depths reduce the cycle time remains the same but the speed of the grabs is automatically reduced. Overriding manual control is arranged so that full flexibility is available i.e. at shallow depths full throughput may be maintained using fewer grabs but operating at faster cycles etc.

The dredge may be dynamically positioned in a very precise manner using a modular type traction unit mooring system consisting of two bow sideline winches, two stern sideline winches, one headline winch and one sternline winch. All trailing lines are automatically tensioned thus ensuring that the dredge is under full control at all times. The system automatically adjusts for changes in wind and sea state thus maintaining an accurate pattern of movement across the area to be mined. Provision may be made in the control system for wave surge, transverse and forward motion, thus ensuring as precise a dredging pattern as possible after making due allowances for response time discrepancies which of course would vary depending upon the magnitude of adverse climatic and sea conditions. The speed of traverse of the dredge across the working area may be automatically linked to the time cycle of the grabs thus ensuring continuous rather than staggered excavation.

Although the mooring system may be designed for automatic and semi-automatic operation it may also be fitted with overriding control to permit full manual operation.

Another feature of the dredge mooring system may be a visual digital display, on the operator's console, of individual mooring line speeds, tensions and line out/-line in measurement. This information is essential when the dredge is not working in automatic mode but under semi-automatic or manual control.

Dredge orientation and location may be monitored and controlled using a suitable ship to shore radio positioning system. Many such systems are in world wide use and are extremely accurate i.e. correct to $\pm 1.5$ meters at 80 kilometers.

A visual display of dredge motion and position may be projected on to a half reflective window in front of the dredge operator. This visual display may have two scales namely:

(1) Panoramic (say eight kilometers) visual, showing land contours and other vessels in the immediate area, similar to a normal radar display with the dredge area and the dredge location marked thereon.

(2) A large scale plan of the actual area in which the dredge would operate showing the relative position of the dredge at any point in time. Superimposed on this visual would be a profile of the sea bed directly under the dredge in the grabbing area.

The arrangement shown in FIGS. 1 to 3 utilises a conventional type pontoon which is sufficient for sheltered off-shore locations and may be used in unsheltered locations provided climatic and sea conditions allow i.e. during rough weather the dredge would have to cease operations.

The multi-grab dredge is more flexible than bucket dredges (literally in the sense that there is no rigid connection between dredge and sea bed) in that the exact point(s) of excavation are less precise relative to the position of the pontoon and that the multi-grab dredge could operate under worse climatic and sea state conditions than the conventional bucket line dredge.

Where the multi-grab dredge is to be used in an exposed area subjected to monsoon or other unfavourable conditions the pontoon is fitted with a dampening construction preferably in the form of a semi-submersible hull.

Through accurate measurement and winch control the dredge will operate in a semi-automatic or automatic mode for all functions including changes in dredging depth. The means by which the sea bed would be identified would be through accurate automatic line-out measurement of the mooring lines and tension monitoring on the sheaves attached to the grabs. Controlled high velocity fall of the grabs coupled with retardation near the sea bed surface would ensure that the grabs do not experience shock loads at the moment of impact.

The grabs themselves may be of the heavy digging type with an adequate de-rated capacity, as compared with re-handling grabs, to ensure the maintenance of the desired throughput under all conditions with reference to the type of material being handled. It must be expected that at great depths the sea bed may be heavily compacted and the design and self weight of the grabs must be selected to provide enough digging force to overcome resistance of the material. For this type of excavating a slower than normal grab closing rate is recommended to obtain maximum fill. Another important feature for efficient filling is the maintenance of grab stability at all stages. The use of horizontal boom unloaders at minimum height with short rope lengths once the grab has left the water combined with four ropes on each grab instead of two greatly improves stability and reduces to a minimum the adverse effects of swing and twisting of the grab. The reduction in height also reduces the grabbing cycle time.

Since the entire system would be under general automatic monitoring, a constant and updated record of sea bed conditions both from depth and horizontal co-ordinates, may be plotted and monitored.

Once the excavated material has been discharged into the collecting bins/surge hoppers/elevator boots the processing is then conventional in that it is virtually elementary bucket dredging. The buckets excavate from the collecting bins instead of from the sea beds directly which makes the system, once the material has been discharged from the grabs, relatively simple.

The reason for the elevators, or small bucket ladders, is that material has to be fed into the treatment system at a constant optimum rate to achieve maximum recovery efficiency. This can be achieved to a far greater degree from bins as shown than by direct excavation from the sea bed in the hitherto conventional way. In the event that clay, or other forms of solidified material, are encountered in the mining area then lumps of the size of the grabs being used will be discharged into the bins. The bucket elevators, arranged with articulation facility, will be capable of breaking this down into sizes that the treatment plant can absorb or alternatively, if the material is barren of ore, the lumps could be discharged directly into a chute which effectively by-passes the treatment plant. It is also possible to arrange alternative direct chutes from the grabs to tailings discharge thus by-passing the bins and elevators as well as the treatment plant. These would not necessarily be only for the discharge of solidified material such as barren clay but all forms of barren ground or overburden. This feature has not been shown on the drawing of the multi-grab dredge.

Another advantage in excavating from the bins is that the drop chutes feeding into the screens can be connected directly to the elevator housings thus eliminating spillage which returns directly to the elevator boots. The need for a "Saveall" device does not occur.

The treatment plant preferably consists of trommel screens feeding primary gravity concentration jigs through a system of distribution chutes from the screen hoppers. Upgrading of the ore concentrates from the primary jigs is achieved by circulating through systems of secondary and tertiary gravity concentration jigs. Oversize from the screens and barren ground by-passing the treatment plant would be discharged directly over the stern of the dredge through chutes. Jigs tailings may be either discharged over the back of the dredge through chutes or diverted into sumps and pumped away through floating pipelines.

A very important part of a grab dredging project is that a suitable method is adopted that eliminates the possibility of a grab unit or units becoming buried during operations. This hazard does not normally apply to bucket line dredges simply because of the physical size, strength and power built into a bucket ladder and bucket chain. Accordingly a proper digging pattern is followed to avoid the possibility that the grabs could localise and excavate deep holes prone to sudden infill.

As with bucket line dredging a bench system of excavation may be adopted by a multi-grab dredge to eliminate the possibility of face falls and collapse.

By means of this multi-grab dredge it is possible to dredge areas at depths below those possible, or practicable, by conventional bucket line dredges. Multi-grab dredges designed with semi-submersible hulls may be used for operating in exposed areas even if the dredging depths are within the capabilities of bucket line dredges.

I claim:

1. A dredging and treatment apparatus comprising in combination, (a) a buoyant elongated body having longitudinal extending sides, (b) a container mounted on said buoyant body towards one end thereof, (c) a plurality of rails extending transversely of the longitudinal axis of the body between positions laterally of the longitudinal side of the buoyant body and positions above the container, (d) a plurality of grab units capable of moving along said rails between said positions laterally of said longitudinal side, where the grabs of said units can be lowered for charging with material and raised with the charge, and said positions over said container where the grabs can be discharged, (e) support means on said buoyant body, (f) an inclined bucket elevator pivoted to said support means at its upper end on an axis about which the buckets pass at the upper end of said elevator, the lower end of said bucket elevator being movable towards and away from the bottom of the container according to the level of the material therein, and (g) a treatment plant mounted on said buoyant body towards the other end thereof for receiving the material delivered from the upper end of the bucket elevator, and (h) outlet means from said treatment plant.

2. A dredging and treatment apparatus according to claim 1, wherein the bottom of the container is formed with a sump region into which the lower end of the elevator can extend.

3. A dredging and treatment apparatus according to claim 2, wherein the bottom of the container is also formed with an inclined region contiguous with said sump, said rails at the discharge position of said grabs being located directly over said inclined region.

4. A dredging and treatment apparatus according to claim 3, wherein a further container is provided along side said first container, and said rails extend from positions laterally of both longitudinal sides of the buoyant body to positions over the two containers respectively.

5. A dredging and treatment apparatus according to claim 3, wherein said bucket elevator is pivotally mounted on extensions of the sides of the container.

* * * * *